United States Patent [19]

Field

[11] Patent Number: 4,526,630

[45] Date of Patent: Jul. 2, 1985

[54] HEAT TREATMENT OF ALUMINIUM ALLOYS

[75] Inventor: David J. Field, Tean, England

[73] Assignee: Alcan International Limited, Montreal, Canada

[21] Appl. No.: 477,746

[22] Filed: Mar. 22, 1983

[30] Foreign Application Priority Data

Mar. 31, 1982 [GB] United Kingdom ..... 8209492

[51] Int. Cl.[3] ..... C22F 1/04

[52] U.S. Cl. ..... 148/159

[58] Field of Search ..... 148/13, 11.5 A

[56] References Cited

U.S. PATENT DOCUMENTS 4,094,705 6/1978 Sperry et al. ..... 148/11.5 A

*Primary Examiner*—R. Dean

*Attorney, Agent, or Firm*—Cooper, Dunham, Clark, Griffin & Moran

[57] ABSTRACT

Aluminum alloys containing lithium and copper and/or magnesium as principal alloying constituents are homogenized at 530° C. or above to take into solution as-cast intermetallic phases which do not fully go into solution at conventional homogenization temperatures for this class of alloy. Preferably the alloy ingots are slowly heated at rates not exceeding 50° C./hour up to a final homogenization temperature in the region of 550°-560° C. and are then allowed to cool without prolonged holding at temperature.

9 Claims, No Drawings

HEAT TREATMENT OF ALUMINIUM ALLOYS

The present invention relates to the heat treatment of aluminium alloys. It is well known to apply a homogenisation heat treatment to aluminium alloy ingots in the as-cast state for the purpose of dispersing coarse particles before the commencement of thermomechanical treatments, such as rolling, extrusion, forging to transform the ingot into the desired finished or semi-finished product. All homogenisation heat treatments require to be performed in such a manner that none of the dispersed intermetallic particles are transformed into liquid phases.

There is considerable current interest in aluminium alloys containing substantial amounts of lithium, for example 1–3% Li. Li-containing Al alloys have been shown to exhibit very high strength/weight ratios and amongst these alloys Al-Li-Cu-Mg alloys show particularly interesting possibilities.

Heat treatment procedures have been established for ternary Al-Li-Mg alloys, which comprise an initial heating for 12 hours at 850° F. (about 455° C.) and further heating for 12 hours at 960° F. (about 515° C.). Such alloys contained 2.0–5.0% Mg.

A homogenisation temperature of 500° C. has been suggested for Al-Li-Cu alloys.

In all work on Li-containing alloys investigators tend to work at relatively low temperatures because of the high lithium losses due to oxidation and possibility of local melting.

In experimental work on Al-Li-Cu-Mg alloys it has been found that the homogenisation practices established for Al-Li-Mg alloys are unsatisfactory because some residual coarse copper-bearing phase, remains undissolved. Such coarse phase prevents full development of the combination of mechanical properties during subsequent thermomechanical treatment. Although such coarse phases are to some extent broken down where the alloy ingot is subjected to hot- and cold-rolling to reduce it to sheet or foil gauge thickness, the coarse phases remain virtually unchanged where the original ingot is employed to produce plate, the thickness of which is commonly more than 5% and sometimes as high as 40% of the thickness of the original ingot. In such products residual coarse phases adversely affect the fracture toughness properties, which are very important where the product is to be incorporated into airframes and similar structures.

We have now found that products of improved combinations of mechanical properties can be achieved for Al-Li also containing Cu and/or Mg alloys by adoption of new homogenisation procedures and compositional limitations for the as-cast ingot. We have found that the undesirable coarse copper-bearing phase in an Al-Li-Cu-Mg alloy can be dissolved by heating the as-cast ingot to a temperature in excess of 530° C., while restricting the Mg content so as not to exceed 2%. At higher Mg contents, as employed in the previously known Al-Li-Mg alloys, phases, which become liquid at temperatures below 530° C., are present in as-cast Al-Li-Cu-Mg ingots.

The coarse copper-bearing phase apparently melts at a temperature of about 539° C. in dilute Al-Li-Cu-Mg quaternary alloys. The alloy may be heated more or less rapidly to 530° C. and held at such temperature for periods of about 5 hours, during which time the coarse as-cast phase dissolves to the maximum extent possible at that temperature. It is however preferred to raise the temperature of the as-cast ingot at a relatively slow rate, such as 50° C./hr or less, while raising the temperature of the ingot to the homogenisation temperature at least from a temperature of 450° C. In most instances the slow heating commences at about 200° C. After holding at an homogenisation temperature in the range of 530°–540° C. for the time period indicated the ingot is allowed to cool: it is unnecessary to apply forced cooling by the application of liquid or gaseous coolant.

According to a further development of the invention we have found that the time required to complete the homogenisation treatment and to provide further improved results by dissolution of phases which remain undissolved in the as-cast ingot at 539° C., can be achieved by slow heating of the ingot to a temperature in the range of 540°–560° C. Such heating from 530° C. should certainly not exceed 50° C./hr and more preferably is at a lower rate such as 20° C./hr. However such further heating is particularly advantageous because the time at which the ingot requires to be held at a temperature is dramatically decreased. We have discovered that when the temperature of the entire ingot has been raised under these conditions to 550°–560° C., the ingot may be removed from the heating oven and allowed to cool, without being held at temperature.

It should be noted that, as is well known in the art, the centres of individual ingots take an appreciable time to reach temperature after the furnace atmosphere reaches the desired temperature, the actual time being dependent upon the dimensions of the ingot, the size of the load of ingots and the manner in which the ingots are loaded. Thus it may be necessary to hold a load of ingots for two hours or even more after the selected furnace temperature has been reached, to allow the centres of the ingots to reach the selected temperature.

This preferred treatment has the advantage of reducing lithium losses due to oxidation, because of the great reduction in time at high temperature and because it maximises the dissolution of as-cast phases. A temperature of 560° C. is considered the maximum that could be safely employed in the homogenisation treatment since the bulk alloy Al-Li-Cu-Mg alloy melts, according to composition, at a temperature of about 575° C. Without the special homogenisation treatment of the invention the onset of liquation occurs at a somewhat lower temperature. Indeed to employ the optimum homogenisation temperature the oven employed must be capable of maintaining a very closely controlled temperature throughout so as to avoid local overheating (and therefore melting of the ingot) or local underheating (and failure to fully homogenise). In many cases it may therefore be desirable to employ a somewhat intermediate maximum temperature in the range of 540°–550° C. and to hold the ingot at such temperature for a relatively short time, such as 2–6 hours after the entire ingot has reached temperature.

One of the advantages of the homogenisation treatment of the present invention is that the homogenised ingot is rendered less temperature sensitive during subsequent working stages. For example Al-Li alloy ingots are normally heated to about 520° C. for hot rolling. Ingots homogenised by previous procedures will collapse in the mill if preheated accidentally to above about 530°–540° C. However by reason of elimination of low melting point phases, an alloy ingot homogenised by the procedure of the present invention can be heated to the stated extent without such risk of collapse.

The high temperature homogenisation treatment of the present invention is most advantageous in its application to ingots of aluminium alloys in the composition range 1–3% Li, 0.5–2% Cu, 0.2–2% Mg, up to 0.4% (Fe+Si) up to 0.6% Mn+Cr+Zr, others (impurities) up to 0.05% each and (up to 0.15% total) balance Al; which ingots are to be subjected to less than 95% reduction. The homogenisation treatment is also advantageous when the ingot is to be subjected to greater total reductions. The actual improvement in mechanical properties is however less pronounced as compared with the results obtained when the ingot has been subjected to a conventional heat treatment. However the reduction in heat sensitivity remains as advantageous as before.

EXAMPLE

An ingot having the composition of which is given in Table 1 was cast with dimensions of 30×12.5×90 cm and cut into two blocks of equal length. The blocks were given different homogenisation treatments as follows:

1. Homogenisation Procedure of the Invention

Continuously heated at 20° C. per hour to 555° C. and held for 2 hours at temperature to ensure ingot reached temperature at centre, followed by air cooling.

TABLE 1

| | Chemical Composition of Al—Li—Cu—Mg | | | | | |
|---|---|---|---|---|---|---|
| | Li | Cu | Mg | Zr | Fe | Si |
| wt % | 2.77 | 1.18 | 0.80 | .14 | .14 | .04 |

2. Comparative Homogenisation

Heated at 460° C. for 24 hours followed by heating at 490° C. for 24 hours and air cooling.

Each block was scalped to 11.25 cm section and hot rolled to 2.7 cm thick plate. Prior to hot rolling, the blocks were placed next to each other and pre-heated to 520° C. in a gas fired furnace. Utilising reductions of about 20% the finishing temperature of the plate was about 375° C. after 7 passes. The material was solution heat-treated at 520° C. for 2 hours, water quenched and stretched with a 2¼% permanent set. Ageing was carried out utilising a duplex treatment of 8 hours at 170° C. followed by 24 hours at 190° C. Duplicate values for the proof stress (P.S), ultimate tensile strength (U.T.S.), percentage elongation (el %) and fracture toughness (K) were obtained using standard test specimens. The results obtained for the differently homogenised rolled blocks in plate form are given as follows in Table 2.

TABLE 2

| | Test Direction | 0.2% Proof Stress N/mm² | U.T.S. N/mm² | el % | Fracture Toughness MN M-3/2 |
|---|---|---|---|---|---|
| Homogenised by method of invention | Longitudinal | 461 | 522 | 6.9 | 30.08 |
| | Transverse | 464 | 529 | 7.2 | 30.0 |
| | Transverse | 399 | 491 | 7 | 17.18 |
| | Longitudinal | 401 | 487 | 6.9 | 16.51 |
| Homogenised by Comparative Method | Longitudinal | 461 | 526 | 7.2 | 21.6 |
| | Transverse | 464 | 520 | 7.4 | 20.25 |
| | Transverse | 428 | 507 | 7.6 | 12.66 |
| | Longitudinal | 426 | 507 | 7.2 | — |

It will be observed that when tested in the longitudinal transverse direction the two different homogenisation treatments the tensile strength and percentage elongation values obtained were virtually identical, but the fracture toughness had been improved by 40–50%. In the transverse longitudinal direction there is a small decline in the other mechanical properties, but there is a 30–40% improvement in fracture toughness.

It is also found that an ingot of an Al-Li-Cu-Mg alloy of a composition within the range stated above is more readily rollable when subjected to the homogenisation procedure of the present invention as compared with previously known procedures. In particular it is found that there is less edge-cracking during rolling and consequently greater recovery of useable material.

The homogenisation treatment of the invention is also beneficial in the treatment of known Al-Li-Cu alloys in which the Li content is 1–3% and the Cu content is in the range of 0.5–4% and also with such alloys having a low content of Mg, for example, 0–0.2% Mg.

We have also found that the principles of the invention can be employed to produce improved Al-Li-Mg ternary alloys in the form of sheet and plate. In both cases micrographs show an improved microstructure and a substantial reduction in residual as-cast coarse phases.

It has been found that the known procedure for the heat treatment of Al-Li-Mg alloys as outlined above, does not bring all insoluble phases into solution and it is indeed found necessary to submit the heat treated alloy to very heavy reduction in order to break down and disperse the residual insoluble phases. Accordingly Al-Li-Mg alloy plate products, which commonly involve less than 95% reduction of the cast ingot, have indifferent physical properties.

The application of the present invention permits the production of Al-Li-Mg sheet and plate of improved properties. In this class of alloys the Mg content is above 0.8% and they are essentially Cu-free (less than 0.1% Cu.).

It has been found that the method of the invention, which requires homogenisation at a temperature of at least 530° C. coupled with slow heating to temperature, is applicable only to Al-Li-Mg alloys having Mg contents in the range of 2–4%. Above 4% Mg the alloy is subject to gross melting at temperatures of the order of 510° C. The Li content should not exceed 3% and is preferably in the range 1.0–2.5%. The combined content of Mg and Li should not exceed 6.0% so that at Mg levels above 3.0%, the maximum permissible Li level is below 3%.

With Li and Mg contents within the above limits it is found that considerably improved micro structures are achieved when the alloy is subjected to homogenisation at a temperature of at least about 530° C. and is raised to that temperature at a rate not exceeding 50° C./hr from at least 400° C. and preferably from 200° C. The final homogenisation temperature for Al-Li-Mg alloys will be dependent upon the liquation temperature of the particular alloy composition and should be not less than 15° C. below such bulk melting temperature.

In both Al-Li-Mg and Al-Li-Cu alloys the presence of Zr+Cr+Mn, Fe, Si, and other impurities may be tolerated in the same amounts as indicated above with regard to the quaternary Al-Li-Mg-Cu alloys.

It will be seen that while the homogenisation process of the invention is not applicable to all ternary and quaternary Al, 1–3% Li alloys with Mg and Cu, the principles of the invention are widely applicable. Generally stated the principle of the invention is to heat the alloy to a temperature of at least 530° C., but below the melting point of coarse included phases and to hold the alloy at such a temperature until all such phases have gone into solid solution. As such solution of coarse phases progresses the temperature of the ingot is desirably slowly raised to speed up such solution and thus shortening the duration of high temperature heating and consequently reducing the oxidation loss of the lithium content.

As will be apparent the procedure of the invention provides the possibility of various advantages 1. Improved fracture toughness of worked products at relatively low percentage deformations.
2. Decrease in heat sensitivity of the homogenised ingot before commencement of rolling.
3. Decrease in Li loss during homogenisation.

According to the invention there is provided a procedure for the homogenisation of ingots of ternary and quaternary alloys in the system of Al-Li-Cu-Mg which comprises heating the alloy to a temperature of at least 530° C., but below the melting point of solid intermetallic phases contained therein and maintaining the alloy at a temperature above 530° C. until such phases have entered solid solution in the alloy and then cooling the ingot, said ingot being formed of an alloy in one of the following composition ranges (1) 1–3% Li, 0.5–2% Cu, 0.2–2% Mg.

(2) 1–3% Li, 2–4% Mg, below 0.1% Cu and having a total Li+Mg content of no more than 6.0%.

(3) 1–3% Li, 0.5–4% Cu and up to 0.2% Mg the remainder of each of the above being Al, containing other elements in amounts in the following ranges (Zr+Mn+Cr) 0–0.6% Fe+Si 0–0.4% impurities up to 0.15% total (up to 0.05% each).

I claim:

1. A process for the homogenisation of ingots of ternary and quaternary alloys in the system in the system Al-Li-Cu-Mg which comprises heating the alloy ingot to a temperature of at least 530° C., but below the melting point of solid intermetallic phases contained therein and maintaining the alloy ingot at a temperature above 530° C. until such phases have entered solid solution in the alloy and then cooling the ingot, said ingot being formed of an alloy selected from the group consisting of (1) an alloy consisting essentially of 1–3% Li, 0.5–2% Cu, 0.2–2% Mg, (Zr+Mn+Cr) up to 0.6%, (Fe+Si) up to 0.4%, other elements up to 0.05% each, up to 0.15% total, balance Al;

(2) an alloy consisting essentially of 1–3% Li, 2.4% Mg, below 0.1% Cu and having a total Li+Mg content of no more than 6.0%, (Zr+Mn+Cr) up to 0.6%, (Fe+Si) up to 0.4%, other elements up to 0.05% each, up to 0.15% total, balance Al;

(3) an alloy consisting essentially of 1–3% Li, 0.5–4% Cu, up to 0.2% Mg, (Zr+Mn+Cr) up to 0.6%, (Fe+Si) up to 0.4%, other elements up to 0.05% each, up to 0.15% total, balance Al.

2. A process according to claim 1 in which the ingot temperature is raised at a rate not exceeding 50° C./hr during the heating of the ingot from 400° C. to 530° C.

3. A process according to claim 1 in which the ingot temperature is raised at a rate not exceeding 50° C./hr during the heating of the ingot from 200° C.

4. A process according to claim 1 in which the alloy has the composition 1–3% Li
0.5–2% Cu
0.2–2% Mg
up to 0.4% Fe+Si
up to 0.6% (Mn+Cr+Zr)
others (impurities) up to 0.15% total (up to 0.05% each)
comprising heating the alloy to a temperature above 540° C.

5. A process according to claim 4 in which the alloy ingot is held at a temperature in the range of 540°–550° C. for 2–6 hours.

6. A process according to claim 4 in which the ingot is heated to a temperature of at least 550° C. from 530° C. at a rate not exceeding 50° C./hour and is then allowed to cool.

7. A process according to claim 4, in which the ingot is heated to above 540° C. from a temperature not exceeding 450° C. at a rate not exceeding 50° C./hr.

8. A process according to claim 5 in which the ingot is heated to above 540° C. from a temperature not exceeding 450° C. at a rate not exceeding 50° C./hr.

9. A process according to claim 6 in which the ingot is heated to above 540° C. from a temperature not exceeding 450° C. at a rate not exceeding 50° C./hr.

* * * * *